US007769313B2

(12) United States Patent
Matsuyama et al.

(10) Patent No.: US 7,769,313 B2
(45) Date of Patent: Aug. 3, 2010

(54) CHARGING DEVICE AND IMAGE FORMING APPARATUS

(75) Inventors: Kazuhiro Matsuyama, Ikoma (JP); Toshiki Takiguchi, Yamatokoriyama (JP); Hirokazu Yamauchi, Uji (JP); Hiroyuki Murai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 200 days.

(21) Appl. No.: 11/826,273

(22) Filed: Jul. 13, 2007

(65) Prior Publication Data

US 2008/0019728 A1 Jan. 24, 2008

(30) Foreign Application Priority Data

Jul. 21, 2006 (JP) ..... 2006-199675
Jul. 26, 2006 (JP) ..... 2006-203823

(51) Int. Cl.
*G03G 15/02* (2006.01)

(52) U.S. Cl. ..... 399/100; 399/99

(58) Field of Classification Search ..... 399/98–100, 399/115, 168, 170, 172–173
See application file for complete search history.

(56) References Cited

U.S. PATENT DOCUMENTS 4,864,363 A * 9/1989 Shinada ..... 355/133
6,046,974 A * 4/2000 Uehara ..... 720/663
6,415,120 B1 * 7/2002 Tashiro et al. ..... 399/100
6,724,714 B1 * 4/2004 Kato et al. ..... 720/672
6,931,225 B2 * 8/2005 Yamashita ..... 399/100
6,963,705 B2 * 11/2005 Quinones ..... 399/100

FOREIGN PATENT DOCUMENTS

| | | |
|---|---|---|
| JP | 07-175299 | 7/1995 |
| JP | 09-062063 | 3/1997 |
| JP | 09-119499 | 5/1997 |
| JP | 11-338265 | 12/1999 |
| JP | 2001-66914 A | 3/2001 |
| JP | 2001-343813 A | 12/2001 |
| JP | 2004-302220 | 10/2004 |

* cited by examiner

*Primary Examiner*—David M Gray
*Assistant Examiner*—G. M. Hyder
(74) *Attorney, Agent, or Firm*—Nixon & Vanderhye, PC

(57) ABSTRACT

A charging device includes a rotatable screw gear, a motor, a support, and a protruding member. The screw gear is positioned along length of a linear electrode. The motor rotates the screw gear in forward and reverse directions. The support holds the cleaning member mounted so as to be in contact with the electrode, and is mounted unrotatably but reciprocably between a first end and a second end of the electrode. The member extends perpendicular to the length of the electrode from the support, and has a projection for being elastically fitted into a thread groove of the screw gear along a radial direction of the screw gear. The member is configured in such a manner that a distance between a starting point of elastic deformation of the member and a contact point between the projection and a thread of the screw gear differs according to whether the support is moved forward or backward.

4 Claims, 7 Drawing Sheets

CHARGING DEVICE AND IMAGE FORMING APPARATUS

CROSS REFERENCE

This Nonprovisional application claims priority under 35 U.S.C. §119(a) on Patent Application No. 2006-199675 and No. 2006-203823 filed in Japan on Jul. 21, 2006 and Jul. 26, 2006 respectively, the entire contents of which are hereby incorporated by reference.

BACKGROUND OF THE TECHNOLOGY

The technology relates to a charging device for discharging in an electrophotographic image forming process and to an image forming apparatus provided with the charging device.

A noncontact charging device adapted for use in an electrophotographic image forming apparatus includes an electrode. Application of high voltage to the electrode causes the electrode to discharge toward a photoreceptor. A needle electrode commonly used has the advantage of generating only a small amount of ozone on application of high voltage thereto.

However, a portion of the needle electrode that generates a high-voltage electric field attracts ambient dust.

Large amounts of dust on the electrode prevent proper discharge thereof.

JP H11-338265A discloses a charging device that includes a needle electrode and a pair of pads. The electrode has a plurality of arrayed needles. The pads are movably supported on both sides of the needle array of the electrode. Movement of the pads along the needle array brings the pads into contact with the needles in order so as to remove dust from the needles.

In the prior art device, a cleaning member including the pads are manually moved. Thus, the electrode sometimes cannot be cleaned at an appropriate time according to the amount of dust thereon.

A feature is to provide a charging device capable of reciprocating a cleaning member precisely and accurately between both ends of a needle electrode with a simple control and configuration irrespective of the amount of dust on the electrode, and an image forming apparatus provided with the charging device.

SUMMARY OF THE TECHNOLOGY

A charging device includes a rotatable screw gear, a motor, a support, and a protruding member. The screw gear is positioned along length of a linear electrode. The motor rotates the screw gear in forward and reverse directions. The support holds a cleaning member mounted so as to be in contact with the electrode. The support is mounted unrotatably but reciprocably between a first end and a second end of the electrode. The protruding member extends perpendicular to the length of the electrode from the support. The member has a projection for being elastically fitted into a thread groove of the screw gear along a radial direction of the screw gear. The member is configured in such a manner that a distance between a starting point of elastic deformation of the member and a contact point between the projection and a thread of the screw gear differs according to whether the support is moved forward or backward.

When the motor rotates the screw gear in the forward direction, the projection is brought into contact with a second-end side of the thread of the screw gear, so that the support is moved forward. When the motor rotates the screw gear in the reverse direction, the projection is brought into contact with a first-end side of the thread of the screw gear, so that the support is moved backward.

When the screw gear continues to be rotated after the support has reached the second end as an end along the forward direction or the first end as an end along the backward direction, the member becomes elastically deformed, so that the projection is displaced in a direction to go over the thread. The elastic force exerted on the member varies according to a deformation angle thereof. The deformation angle, depending on a distance between a starting point of elastic deformation of the member and a contact point between the projection and the thread, differs according to whether the support is moved forward or backward. The member is configured to become deformed comparatively easily at either one of the first and second ends even when the screw gear is rotated for too long. This eliminates the need for precise control of rotation of the screw gear.

DETAILED DESCRIPTION OF THE TECHNOLOGY

Figure 1:
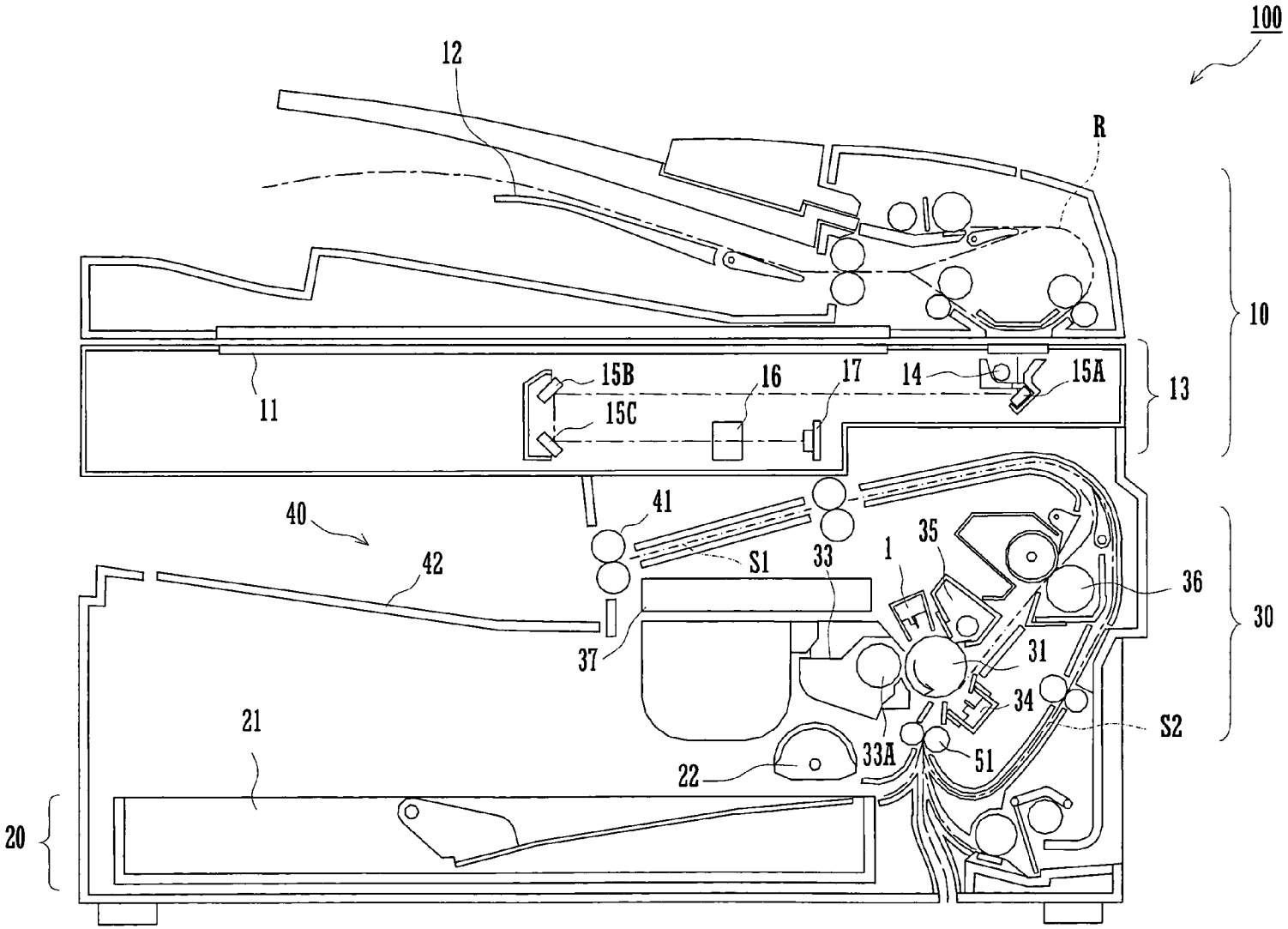
FIG. 1 is a cross-sectional view of an image forming apparatus that includes a charging device.

With reference to the accompanying drawings, preferred embodiments will be described below. FIG. 1 is a cross-sectional view of an image forming apparatus 100 that includes a charging device 1. The apparatus 100 forms an image on paper (including recording medium such as OHP) in any one of copier, printer, and facsimile modes as selected by a user. The apparatus can print images on both sides of paper.

The apparatus 100 includes a document reading section 10, a paper feeding section 20, an image forming section 30, a paper output section 40, and an operating panel section (not shown). Positioned at top of the apparatus 100, the section 10 has a glass platen 11, a document tray 12, and an optical scanning system 13. The system 13 has a light source 14, reflecting mirrors 15A to 15C, an optical lens 16, and a charge coupled device (CCD) 17. The source 14 irradiates with light an original document placed on the platen 11 or being transported on a document transport path R from the tray 12. The mirrors 15A to 15C reflect the light reflected from the document and direct it to the lens 16. The lens 16 focuses the reflected light on the CCD 17. The CCD 17 outputs an electric signal according to the amount of the reflected light.

Positioned at bottom of the apparatus, the paper feeding section 20 has a paper feeding tray 21 and a pick-up roller 22. The tray 21 stores therein paper to be fed into a paper transport path S1 in an image forming process. The roller 22 is rotated to feed paper from the tray 21 into the path S1.

The image forming section 30 is positioned below the section 10. The section 30 has a laser scanning unit (LSU) 37, a photoreceptor drum 31, and a fusing device 36. Around the drum 31, the charging device 1, a developing unit 33, a transfer device 34, and a cleaning unit 35 are arranged in that order along a rotational direction of the drum 31 as indicated by an arrow in FIG. 1.

Positioned above the tray 21, the paper output section 40 has paper output rollers 41 and a paper output tray 42. The rollers 41 output paper transported on the path S1, to the tray 42. The rollers 41 are rotatable in a forward direction to output paper and in a reverse direction. In double-sided image formation, the rollers 41 are rotated in the reverse direction while nipping therebetween paper transported on the path S1 and bearing an image on a first side, to send the paper into a paper transport path S2. The paper is thus reversed, with a second side facing the drum 31 for transfer of a toner image thereto. On the tray 42, paper output by the rollers 41 are accumulated into a stack.

When a start key on the operating panel section is pressed, the apparatus 100 rotates the roller 22 to feed paper into the path S1. The fed paper is transported by registration rollers 51 provided on the path S1.

The rollers 51 are not rotating when a leading end of the paper reaches the rollers 51. The rollers 51 start to rotate when the leading end of the paper meets a leading end of a toner image formed on the drum 31 between the drum 31 and the device 34.

Image data read by the section 10 undergoes image processing on the conditions entered through the operating panel section and then sent as print data to the LSU 37. The device 1 charges the surface of the drum 31 to a predetermined potential. The LSU 37 forms an electrostatic latent image on the charged surface by irradiating the surface of the drum 31 with a laser beam modulated according to the image data. The device 1 corresponds to the charging device of the Claims.

Then, toner adhering to a circumferential surface of a magnet roller 33A, which is provided in the unit 33, is attracted by and sticks to the surface of the drum 31 according to the potential gaps on the surface, so that the electrostatic latent image is developed into a toner image.

The device 34 transfers the toner image from the drum 31 to paper. The device 1 may be used for the device 34. The unit 35 removes and collects toner remaining on the drum 31 after the transfer process.

After the transfer process, the paper is heated and pressurized while passing through the fusing device 36, so that the toner image is fused and fixed to the paper. Then, the paper is guided to the section 40.

Figure 2B:
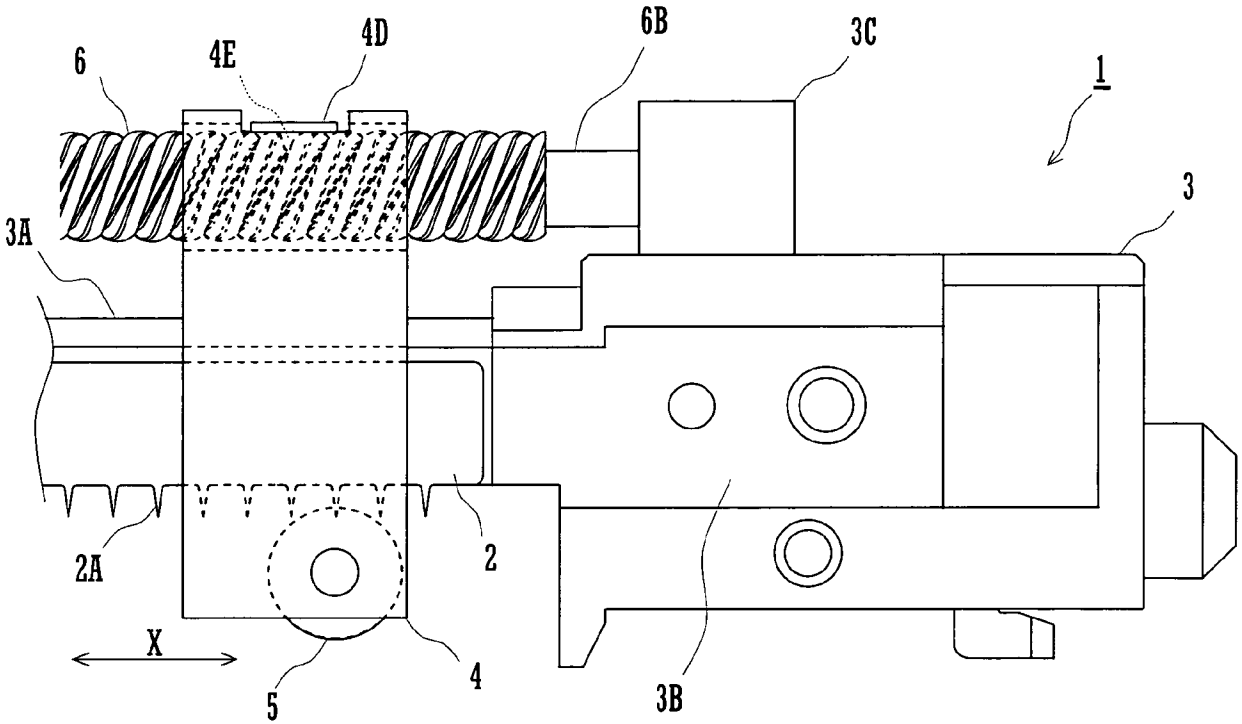
FIG. 2B is a side view of a relevant part of the device.
Figure 2A:
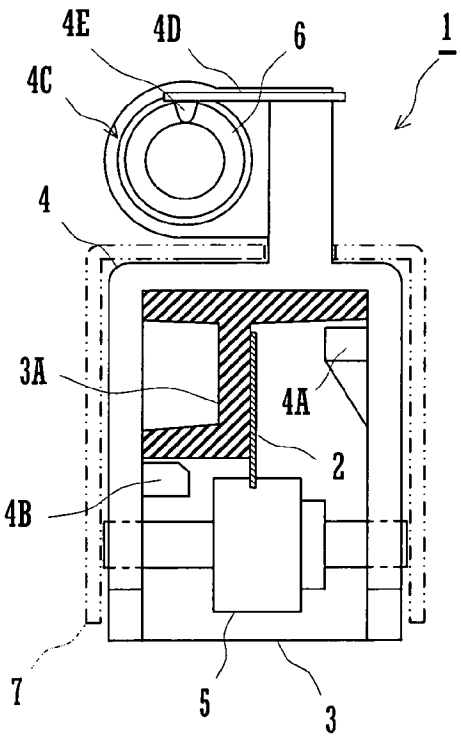
FIG. 2A is a front cross-sectional view of a charging device.

FIG. 2A is a front cross-sectional view of the device 1, and FIG. 2B is a side view of a relevant part of the same. The device 1 includes a needle electrode 2, a holder 3, a support 4, a cleaning roller 5, a screw gear 6, and a casing 7. The device 1 is located above the drum 31.

The electrode 2 is a thin metal strip with a plurality of needles 2A extending downward from its bottom. The needles 2A are regularly spaced along the length of the electrode 2. The needles 2A are arrayed along an X-axis that is parallel to a direction of the length of the electrode 2. The device 1 is positioned with the length direction of the electrode 2 parallel to an axis of the drum 31. The X-axis is therefore parallel to the axis of the drum 31. The length of the electrode 2 is longer than an axial length of the circumferential surface of the drum 31.

The holder 3 is formed of an insulating material such as resin. The holder 3 has a holding section 3A and a terminal section 3B. The section 3A holds the electrode 2 and is longer than a distance between both endmost needles 2A of the electrode 2. The section 3A has a cross-sectional shape, as shown by hatches in FIG. 2A, with respect to a plane normal to the X-axis. The section 3B stores therein a terminal (not shown) for connecting a high-voltage power supply (also not shown) to a rear end of the electrode 2. The rear end corresponds to the second end of the Claims.

The support 4 is open at bottom and mounted slidably on the outside of the section 3A. The support 4 has projections 4A and 4B formed on inner side surfaces thereof. The support 4 holds the section 3A vertically between top inner surface thereof and the projections 4A and 4B, and horizontally between the inner side surfaces. This prevents rotation and other motions of the support 4 in the plane normal to the X-axis.

The cleaning roller 5, which corresponds to the cleaning member of the Claims, is rotatably mounted on a lower end of the support 4. As an example, the roller 5 includes an elastic body containing an abrasive lower in hardness than the material of the electrode 2 and higher in hardness than dust such as toner. Tips of the needles 2A sink in a circumferential surface of the roller 5.

The roller 5 can be formed of a suitable elastic body selected by experiment out of known rubber or resinous materials on the condition that the material deforms elastically without being cut easily by the needles 2A sinking into and coming out of it. The abrasive can be selected suitably from known materials on the condition that the material can remove toner and dust from the surfaces of the needles 2A without damaging the surfaces. The abrasive can be contained in the elastic body by a known method.

The screw gear 6 is rotatably mounted with a rear end 6B fitted in a bearing 3C of the holder 3. The screw gear 6 is inserted through a hole 4C of the support 4.

From an upper surface of the support 4, a protruding member 4D extends horizontally and perpendicular to the length of the screw gear 6. The member 4D is a plate formed of an elastically deformable material such as resin. The member 4D has a projection 4E. The projection 4E is fitted in a thread groove of the screw gear 6 along a radial direction of the screw gear 6.

The casing 7 extends over the length of the holder 3 and covers the support 4. The casing 7 shields the electrode 2.

When a high voltage is applied to the electrode 2 through the terminal stored in the section 3B, the applied electric field concentrates at the tips of the needles 2A. This causes the needles 2A to discharge to the surface of the drum 31, so that the surface is charged to the predetermined potential.

The cross section of the section 3A that is normal to the X-axis is uniform in shape at least between both endmost needles 2A. As discussed earlier, the support 4 is mounted on the outside of the section 3A and prevented from rotating and moving otherwise in the plane normal to the X-axis. The support 4 is mounted so as to be slid along the X-axis along the section 3A at least between both endmost needles 2A when the screw gear 6 is rotated. When the screw gear 6 is rotated, the projection 4E is brought into contact with the threads of the screw gear 6, so that the support 4 is slid along the X-axis.

Figure 3:
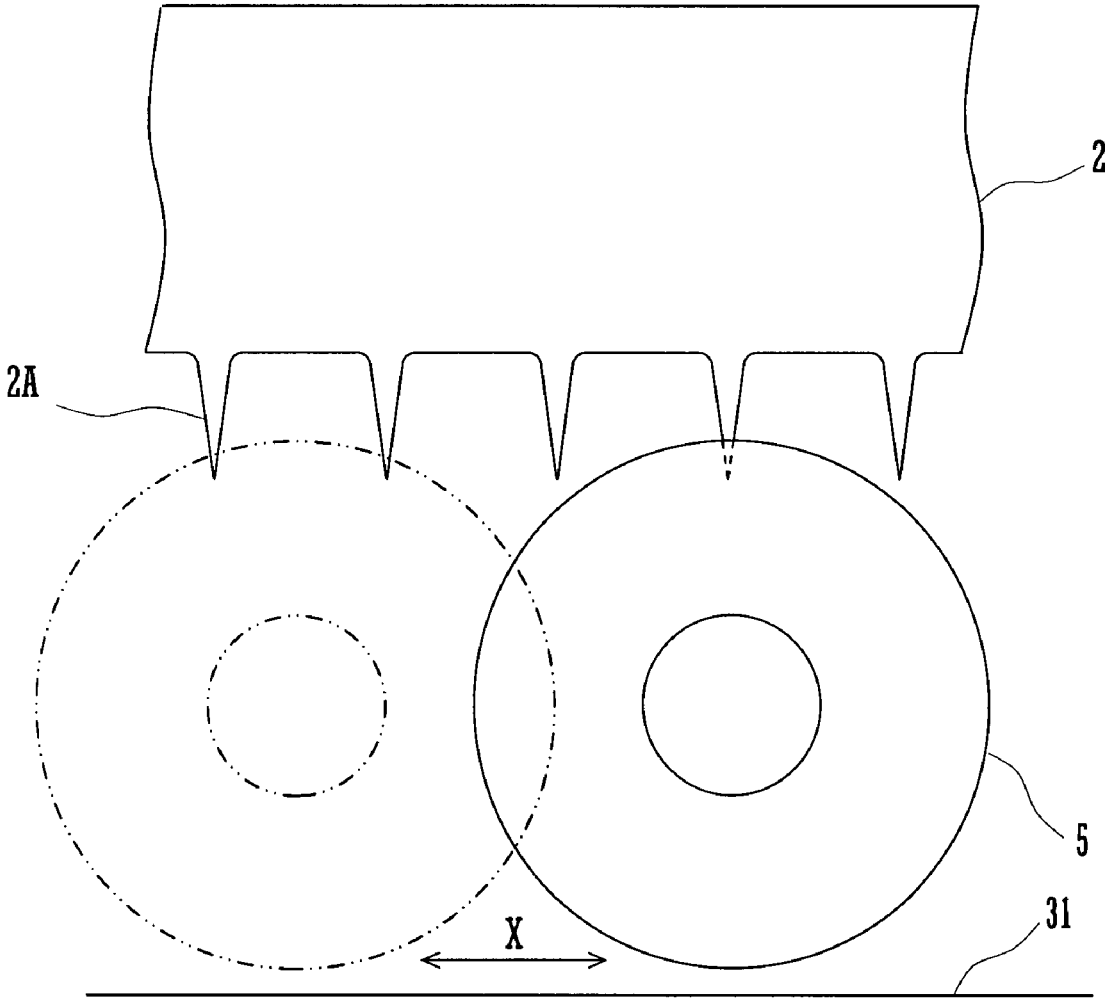
FIG. 3 is a view illustrating a cleaning operation of a cleaning roller provided in the device.

FIG. 3 is a view illustrating a cleaning operation of the roller 5. The tips of the needles 2A sink in the circumferential surface of the roller 5, which is supported rotatably by the support 4. While the support 4 is moving with the roller 5 along the X-axis, the tips of the needles 2A sink in order in the surface of the roller 5. While moving along the X-axis, the roller 5 is rotated by resistance acted on the surface thereof by the needles 2A.

The cleaning roller 5 is positioned between the electrode 2 and the circumferential surface of the drum 31. It is essential that the roller 5 be as large as possible in diameter without being in contact with the surface of the drum 31. While the roller 5 is moving along the X-axis, the tip of at least one of the needles 2A is sinking in the circumferential surface of the roller 5. This ensures that the roller 5 is rotated when moving along the X-axis, thereby minimizing damage to the surface of the roller 5 by the tips of the needles 2A and deformation of the needles 2A by the surface of the roller 5.

The roller 5 is supported by the support 4 in such a manner that the needles 2A sink as deep as about 0.5 mm into the surface of the roller 5. While the support 4 is moving with the roller 5 along the X-axis, the tips of the needles 2A sink gradually into the roller 5 and subsequently come gradually out of it. While the tips of the needles 2A are sinking into and coming out of the roller 5, their overall surfaces come into contact with the elastic body of the roller 5 and are ground by the abrasive contained in this body. Because the roller 5 rotates while the needles 2A are sinking into and coming out of it in order, at least adjacent needles 2A sink in different positions into the roller 5. This ensures that the overall surfaces of the tips of the needles 2A are cleaned.

Figure 4:
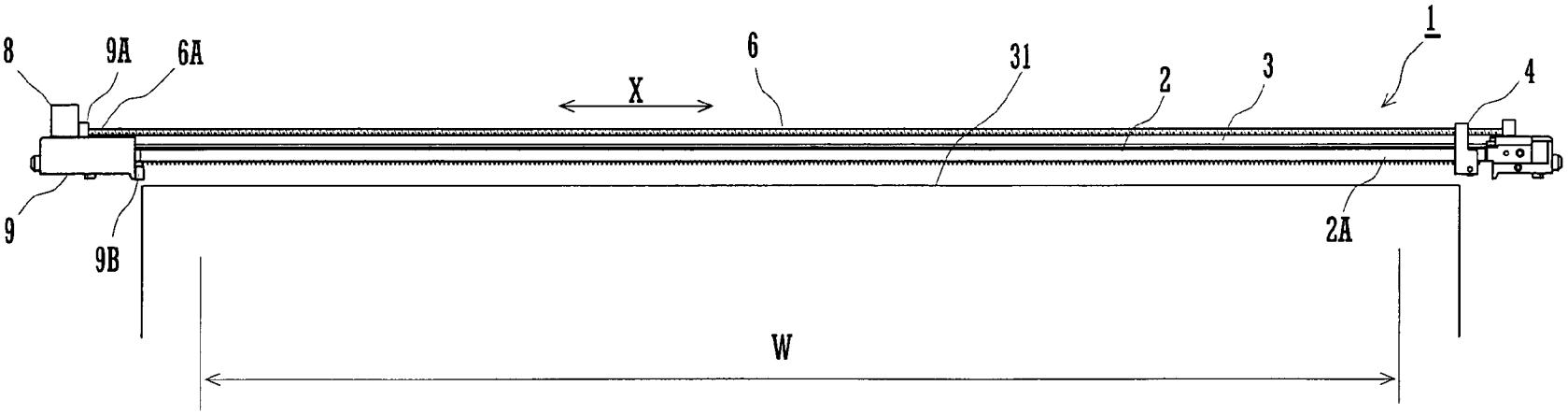
FIG. 4 is a side view of the device.

FIG. 4 is a side view of the device 1. The screw gear 6 is positioned at the top of the device 1 and extends over the roughly whole length of the holder 3. As discussed earlier, the rear end 6B of the screw gear 6 is fitted in the bearing 3C of the holder 3.

The electrode 2 held by the holder 3 includes a mounting section 9 formed at a frond end. The front end corresponds to the first end of the Claims. The section 9 is nearly identical in outer shape to the section 3B. The section 9 has a bearing 9A, a motor 8, and a sensor 9B. The bearing 9A is formed on top of the section 9. The bearing 9A has a front end 6A of the screw gear 6 rotatably fitted therein. Mounted on the top of the section 9, the motor 8 serves to rotate the screw gear 6 in forward and reverse directions. Mounted on the bottom of the section 9, the sensor 9B serves to detect the support 4.

The motor 8 is rotated in a forward direction or a reverse direction according to driving data output from either of respective control sections provided in the apparatus 100 and the device 1.

The sections 3B and 9 are positioned outside an image formation area W on the circumferential surface of the drum 31 when the device 1 is mounted in the apparatus 100. In a state in which the electrode 2 is not being cleaned, meanwhile, the support 4 is positioned in a stand-by position set on a side of the front end of the electrode 2 and outside the area W. Accordingly, the support 4, the sections 3B and 9, and the motor 8 do not obstruct image formation on the surface of the drum 31.

When the electrode 2 is to be cleaned, the screw gear 6 is first rotated for a predetermined time by the motor 8, so that the support 4 is moved forward, i.e., from the front end to the rear end of the electrode 2, along the X-axis. Contact resistance acted on the roller 5 by the electrode 2 varies depending on the amount of dust on the needles 2A, and the travel speed of the support 4 varies depending on the contact resistance. The predetermined time is set equal to, or longer than, a time that the support 4 takes to move forward from the front end to the rear end of the electrode 2 when the contact resistance is the highest. This ensures that the support 4 reaches the rear end of the electrode 2 irrespective of the amount of dust on the needles 2A.

After the predetermined time has lapsed since the motor 8 starts to rotate the screw gear 6 in the forward direction, the motor 8 then rotates the screw gear 6 in the reverse direction until the sensor 9B detects the support 4. Consequently, the support 4 is moved backward, i.e., from the rear end to the front end of the electrode 2, along the X-axis and returns to the stand-by position.

Thus, the support 4 is reciprocated on the section 3A along the X-axis. In this reciprocation, the tips of the needles 2A sink in order in the surface of the roller 5 being rotated.

While the tips of the needles 2A are sinking into and coming out of the roller 5, their overall surfaces come into contact with the roller 5. This ensures that the overall surfaces of the tips of the needles 2A are cleaned without deforming the needles 2A and causing fibers to stick to the needles 2A.

It is not essential that the cleaning member of the Claims be the cleaning roller 5, but it is essential that this member be a rotor supported rotatably by the support 4.

Figure 5A:
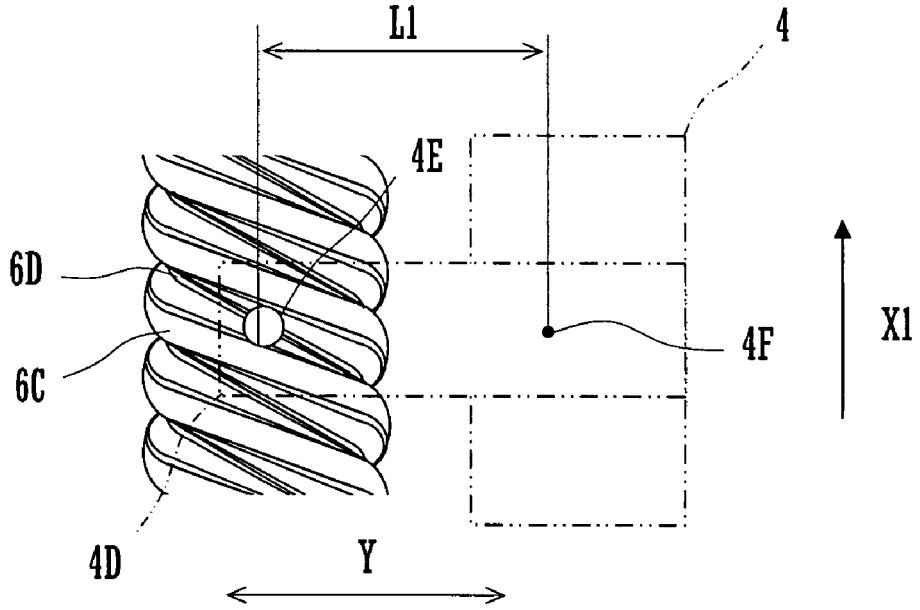
FIG. 5A is a plan view of a relevant part of the device.
Figure 5B:
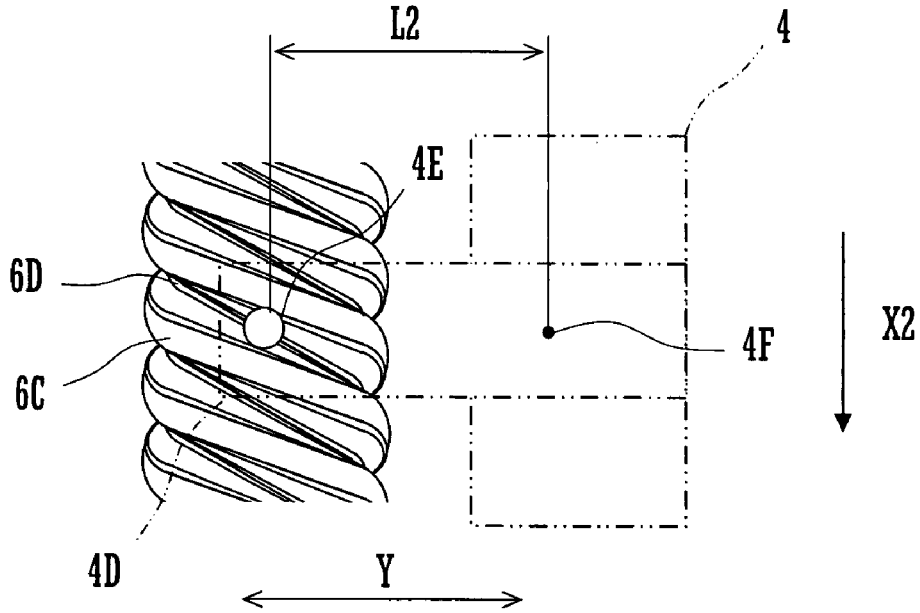
FIG. 5B is another plan view of the relevant part of the device.

FIGS. 5A and 5B are plan views of a relevant part of the device 1 illustrating how the projection 4E is in contact with a thread 6C of the screw gear 6. As discussed earlier, the protruding member 4D extends from the upper surface of the support 4. In the member 4D, the projection 4E is formed to be fitted in a thread groove 6D of the screw gear 6 along the radial direction of the screw gear 6. The projection 4E has a partially spherical shape. There is a backlash formed between the projection 4E and two adjacent threads 6C between which the groove 6D is defined.

Due to the backlash, the projection 4E is brought into contact with a rear side of the thread 6C, as shown in FIG. 5A, when the support 4 is moved forward in a direction of arrow X1. The projection 4E is brought into contact with a front side of the thread 6C, as shown in FIG. 5B, when the support 4 is moved backward in a direction of arrow X2.

Since the thread 6C is inclined with respect to the directions X1 and X2, the projection 4E is brought into contact with different sides of the thread 6C when the support 4 is moved forward and backward. Thus, the projection 4E is brought into contact with different points of the thread 6C along a direction along the Y-axis, which is perpendicular to the directions X1 and X2, when the support 4 is moved forward and backward.

When the screw gear 6 continues to be rotated in the forward or reverse direction after the support 4 has reached the end of the electrode 2 along the forward or backward direction, the member 4D becomes elastically deformed, so that the projection 4E is displaced upward, goes over the thread 6C, and becomes fitted into an adjacent groove 6D. The member 4D becomes deformed from a supporting point 4F on which the member 4D is supported on the upper surface of the support 4.

When the support 4 is moved forward and backward, as discussed earlier, the projection 4E is brought into contact with the different points of the thread 6C. Hence, there are different distances between the point 4D and the different contact points between the projection 4E and the thread 6C: a distance L1 measured when the support 4 is moved forward; and a distance L2 measured when the support 4 is moved backward. The distances L1 and L2 correspond to the first and second distances, respectively, of the Claims.

The distance L1 is set longer than the distance L2.

When going over the thread 6C, the projection 4E is displaced upward by the same amount irrespective of whether the support 4 is moved forward or backward. Elastic force acted on the member 4D depends on an angle of upward deformation of the member 4D with respect to the point 4F. The deformation angle, depending on the distance between the point 4F and the contact point between the projection 4E and the thread 6C, is larger when the support 4 is moved backward than when the support 4 is moved forward. Accordingly, a stronger elastic force is acted on the member 4D when the support 4 is moved backward than when the support 4 is moved forward. Thus, the projection 4E goes over the thread 6C more easily when the support 4 is moved forward than when the support 4 is moved backward.

When the support 4 is moved forward, the screw gear 6 is rotated for the predetermined, sufficiently long time. Thus, the screw gear 6 may continue to be rotated after the support 4 has reached the rear end of the electrode 2, so that the projection 4E may go over the threads 6C repeatedly. However, the projection 4E is designed to go over the thread 6C more easily when the support 4 is moved forward. This design prevents damage to the member 4D, the projection 4E, and the screw gear 6 and overload on the motor 8.

When the support 4 is moved backward, in contrast, the sensor 9B detects the support 4 reaching the front end of the electrode 2 and sends out a detection signal to stop the rotation of the screw gear 6. A comparatively larger elastic force is acted on the member 4D if the projection 4E goes over the thread 6C when the support 4 is moved backward. When the support 4 is moved backward, however, the projection 4E is prevented from going over the thread 6C. This prevents damage to the member 4D, the projection 4E, and the screw gear 6 and overload on the motor 8.

As described so far, the sides of the thread 6C with which the projection 4E is to be brought into contact when the support 4 is moved forward and backward are determined in consideration of the magnitude of elastic force acted on the member 4D when the projection 4E goes over the thread 6C. When the support 4 is moved forward, rotating the motor 8 for a constantly fixed time ensures that the support 4 is moved to the rear end of the electrode 2 without the need for detecting the support 4 reaching the rear end. This eliminates the need for a sensor for detecting the support 4 at the rear end, thereby preventing the device 1 from being oversized as well as allowing a simplified drive control of the motor 8. The simplified drive control allows the roller 5 to be properly reciprocated together with the support 4 between the front and rear ends of the electrode 2 without causing inadequate cleaning of the electrode 2 or damage to the device 1 irrespective of the amount of dust on the electrode 2.

Figure 6B:
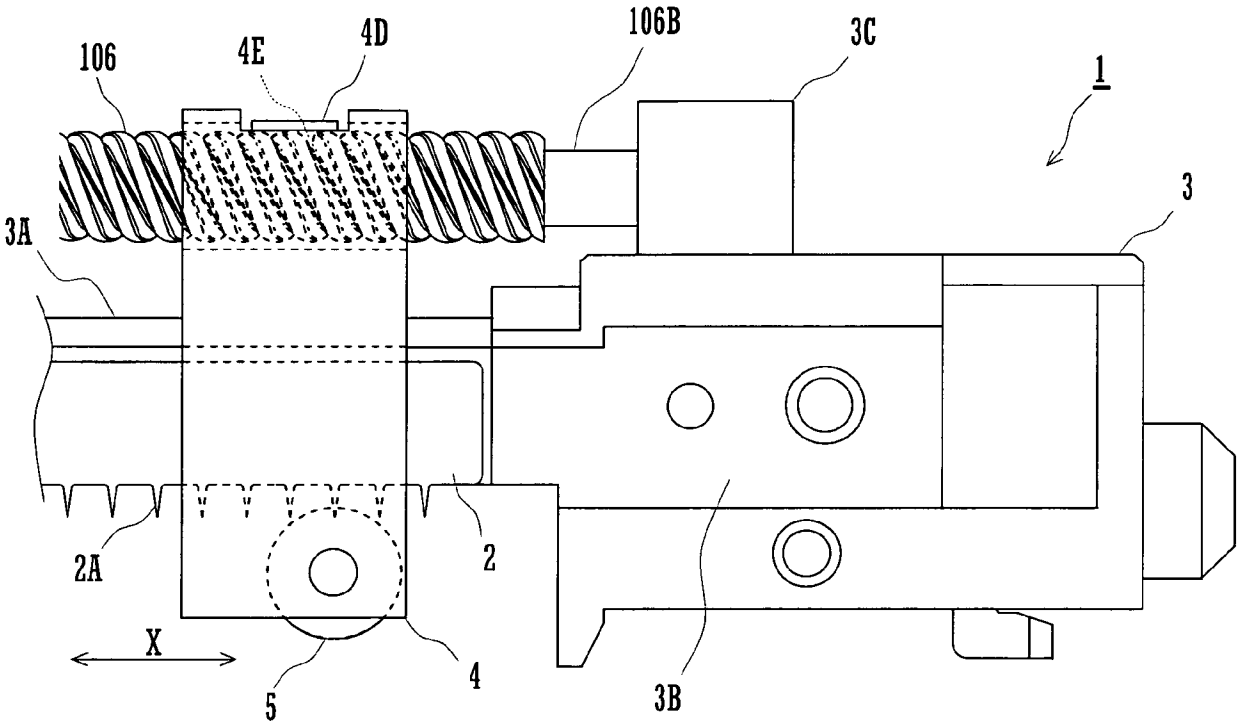
FIG. 6B is a side view of a relevant part of the device.
Figure 6A:
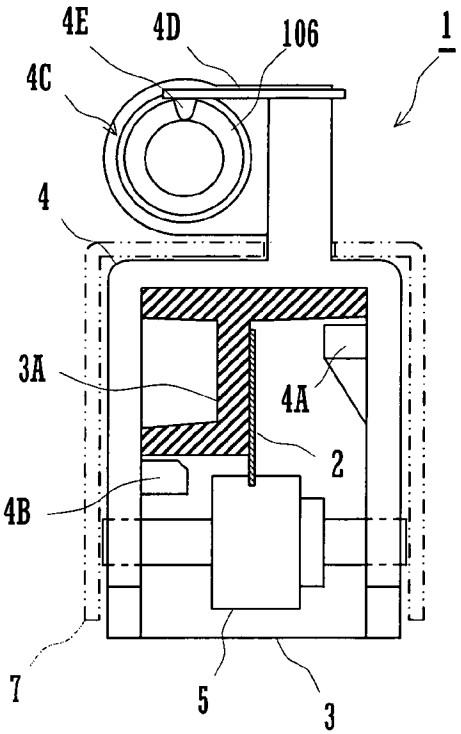
FIG. 6A is a front cross-sectional view of a charging device.

FIG. 6A is a front cross-sectional view of a charging device 101. FIG. 6B is a side view of a relevant part of the same. The device 101 is similar in configuration to the device 1, except that a screw gear 106 is opposite in thread direction to the screw gear 6. In the figures, elements corresponding to those identified with respect to the device 1 are identified by the same reference numerals, and a detailed description of the common elements will be omitted herein for the sake of brevity.

Figure 7A:
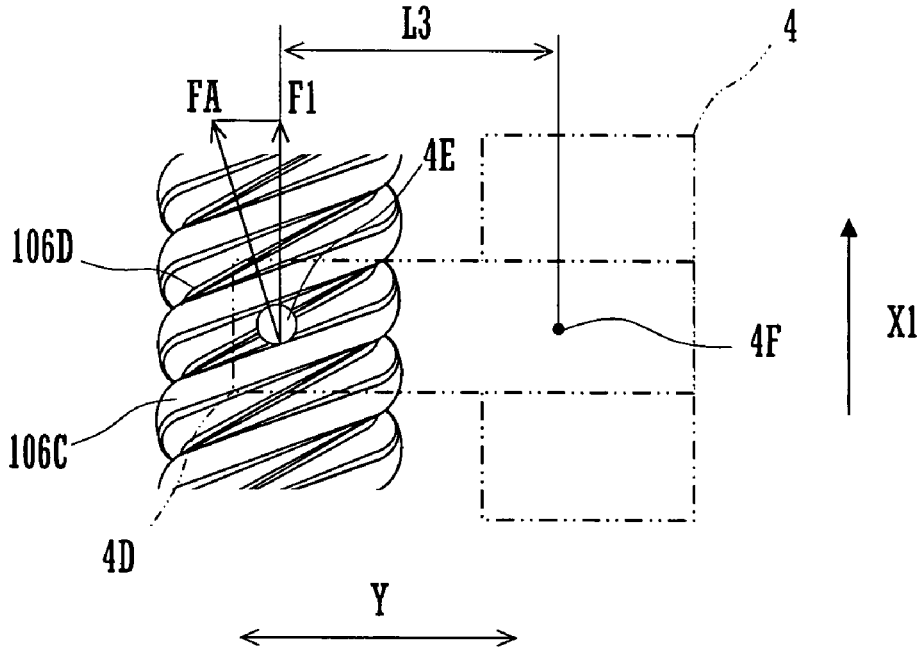
FIG. 7A is a plan view of a relevant part of the device.
Figure 7B:
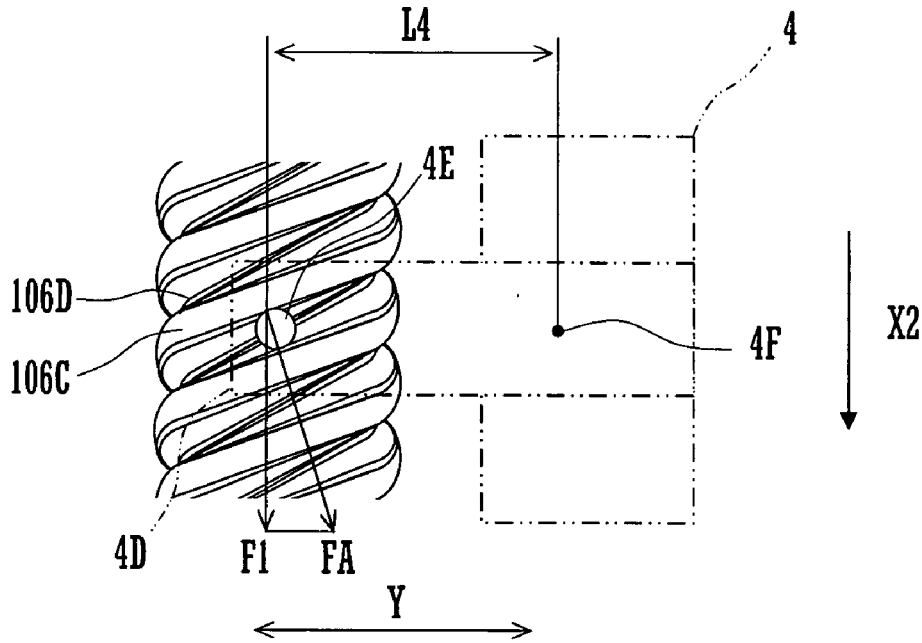
FIG. 7B is another plan view of the relevant part of the device.

FIGS. 7A and 7B are plan views of a relevant part of the device 101 illustrating how the projection 4E is in contact with a thread 106C of the screw gear 106. As discussed earlier, the protruding member 4D extends from the upper surface of the support 4. In the member 4D, the projection 4E is formed to be fitted in a thread groove 106D of the screw gear 106 along the radial direction of the screw gear 106. The projection 4E has a partially spherical shape. There is a backlash formed between the projection 4E and two adjacent threads 106C between which the groove 106D is defined.

Due to the backlash, the projection 4E is brought into contact with a rear side of the thread 106C, as shown in FIG. 5A, when the support 4 is moved forward in a direction of arrow X1. The projection 4E is brought into contact with a front side of the thread 106C, as shown in FIG. 5B, when the support 4 is moved backward in a direction of arrow X2.

Since the thread 106C is inclined with respect to the directions X1 and X2, the projection 4E is brought into contact with different sides of the thread 106C when the support 4 is moved forward and backward. Thus, the projection 4E is brought into contact with different points of the thread 106C along a direction along the Y-axis, which is perpendicular to the directions X1 and X2, when the support 4 is moved forward and backward.

When the screw gear 106 continues to be rotated in the forward or reverse direction after the support 4 has reached the end of the electrode 2 along the forward or backward direction, the member 4D becomes elastically deformed, so that the projection 4E is displaced upward, goes over the thread 106C, and becomes fitted into an adjacent thread groove 106D. The elastic deformation of the member 4D starts at a point 4F on which the member 4D is supported on the upper surface of the support 4.

When the support 4 is moved forward and backward, as discussed earlier, the projection 4E is brought into contact with the different points of the thread 106C. Hence, there are different distances between the point 4D and the different contact points between the projection 4E and the thread 106C: a distance L3 measured when the support 4 is moved forward; and a distance L4 measured when the support 4 is moved backward. The distances L3 and L4 correspond to the first and second distances, respectively, of the Claims.

The distance L3 is set shorter than the distance L4.

In a case where the screw gear 106 continues to be rotated in the forward or reverse direction after the support 4 has reached the end of the electrode 2 along the forward or backward direction, force FA of the same magnitude is acted on the projection 4E by the thread 106C irrespective of whether the support 4 is moved forward or backward. A moment exerted on the point 4F when the support 4 is moved forward is calculated by the distance L3 multiplied by a component F1 of the force FA in an axial direction of the screw gear 106. The moment exerted on the point 4F when the support 4 is moved backward is calculated by the distance L4 multiplied by the component F1. Thus, the moment is larger when the support 4 is moved backward than when the support 4 is moved forward. Accordingly, the deforming force exerted on the member 4D is larger, and the member 4D is therefore more liable to be damaged, when the support 4 is moved backward than when the support 4 is moved forward.

When the support 4 is moved forward, the screw gear 106 is rotated for the predetermined, sufficiently long time. This prevents the support 4 from being moved backward without reaching the rear end of the electrode 2 or from being stopped without reaching the front end of the electrode 2. There is however a possibility that the screw gear 106 may continue to be rotated after the support 4 has reached the rear end of the electrode 2 and that the projection 4E may go over the thread 106C repeatedly. However, a comparatively smaller deforming force exerted on the member 4D when the support 4 is moved forward prevents damage to the member 4D, the projection 4E, and the screw gear 106 and overload on the motor 8, even when the projection 4E goes over the thread 106C repeatedly.

When the support 4 is moved backward, in contrast, the sensor 9B detects the support 4 reaching the front end of the electrode 2 and sends out a detection signal to stop the rotation of the screw gear 106. If, when the support 4 was moved backward, the screw gear 106 continued to be rotated after the support 4 had reached the rear end of the electrode 2, a comparatively larger deforming force would be acted on the member 4D. However, it never happens that, when the support 4 is moved backward, the screw gear 106 continues to be rotated after the support 4 has reached the rear end. This prevents damage to the member 4D, the projection 4E, and the screw gear 106 and overload on the motor 8.

As described so far, the sides of the thread 106C with which the projection 4E is to be brought into contact when the support 4 is moved forward and backward are determined in consideration of the magnitude of deforming force exerted on the member 4D when the screw gear 106 continues to be rotated after the support 4 has reached the rear end. When the support 4 is moved forward, rotating the motor 8 for a constantly fixed time ensures that the support 4 is moved to the rear end of the electrode 2 without the need for detecting the support 4 reaching the rear end. This eliminates the need for a sensor for detecting the support 4 at the rear end, thereby preventing the device 1 from being oversized as well as allowing a simplified drive control of the motor 8. The simplified drive control allows the roller 5 to be properly reciprocated together with the support 4 between the front and rear ends of the electrode 2 without causing inadequate cleaning of the electrode 2 or damage to the device 1 irrespective of the amount of dust on the electrode 2.

Alternatively, the motor 8 may be mounted in the apparatus 100. In this case, the rear end of the screw gear 6 or 106 may be coupled mechanically to the rotational shaft of the motor 8 when the device 1 or 101 is mounted in the apparatus 100. The motor 8 may be activated at regular cleaning times, such as when the apparatus 100 is turned on or after a predetermined number of image forming operations are performed, or at random times, such as when cleaning instructions are given through the operating panel section by a user.

Alternatively, an electrode provided in the device 1 or 101 may include, but not be limited to, a needle electrode such as the electrode 2. The electrode may be a wire electrode, for example. The cleaning member of the Claims may include, but not be limited to, a rotor such as the roller 5. The cleaning member may be a pair of pads supported on both sides of an electrode, for example.

The technology being thus described, it will be obvious that the same may be varied in many ways. Such variations are not to be regarded as a departure from the spirit and scope of the technology, and all such modifications as would be obvious to one skilled in the art are intended to be included within the scope of the following claims.

What is claimed is:

1. A charging device comprising:

a linear electrode;

a cleaning member mounted so as to be in contact with the electrode;

a rotatable screw gear positioned along a length of the electrode;

a motor for rotating the screw gear in forward and reverse directions;

a support for holding the cleaning member, the support being mounted unrotatably but reciprocably between a first end and a second end of the electrode; and a protruding member that extends perpendicular to the length of the electrode from the support, the protruding member having a projection that is elastically fitted into a thread groove of the screw gear along a radial direction of the screw gear, wherein the direction of twist of the threads of the screw gear is configured in such a manner that a distance between a starting point of elastic deformation of the protruding member and a contact point between the projection and a thread of the screw gear is smaller when the support is moved forward away from a home position than when the support is moved backward toward the home position, and wherein the protruding member is sufficiently flexible such that when the support is prevented from moving and the rotatable screw gear continues to rotate, the projection is allowed to ride over the top of the threads while the protruding member elastically flexes.

2. The charging device according to claim 1, wherein the direction of twist of the threads of the screw gear is configured to minimize a moment exerted on the starting point of elastic deformation of the protruding member when the support is moved forward from the first end to the second end.

3. The charging device according to claim 2, wherein, when the support is moved forward, the screw gear is rotated in the forward direction for a predetermined time.

4. The charging device according to claim 3, wherein the predetermined time is set equal to, or longer than, a time that the support takes to be moved forward from the first end to the second end when contact resistance acted on the cleaning member by the electrode is highest.

* * * * *